United States Patent [19]

Stevenson

[11] 4,044,856

[45] Aug. 30, 1977

[54] LIFTING EQUIPMENT HAVING A BOOM STRUCTURE AND A CONTROL MECHANISM FOR USE THEREWITH USING A FLEXIBLE LIGHT GUIDE

[75] Inventor: Robert E. Stevenson, Redwood City, Calif.

[73] Assignee: General Cable Corporation, San Carlos, Calif.

[21] Appl. No.: 598,743

[22] Filed: July 25, 1975

[51] Int. Cl.[2] ..... B66F 11/04

[52] U.S. Cl. ..... 182/2; 250/227

[58] Field of Search ..... 182/2, 141, 148; 250/227, 224, 221, 217 S; 350/96 C; 200/11 TW

[56] References Cited

U.S. PATENT DOCUMENTS

| | | | |
|---|---|---|---|
| 3,136,385 | 6/1964 | Eitel | 182/2 |
| 3,541,340 | 11/1970 | Binks | 250/227 |
| 3,624,404 | 11/1971 | Hines | 250/227 |
| 3,761,719 | 9/1973 | Stoever | 250/227 |
| 3,811,047 | 5/1974 | Shragal | 250/221 |
| 3,844,378 | 10/1974 | Balogh | 182/2 |

FOREIGN PATENT DOCUMENTS

| | | | |
|---|---|---|---|
| 2,016,498 | 10/1971 | Germany | 350/96 C |
| 1,946,693 | 8/1970 | Germany | 350/96 C |

*Primary Examiner*—Reinaldo P. Machado
*Attorney, Agent, or Firm*—Flehr, Hohbach, Test, Albritton & Herbert

[57] ABSTRACT

Lifting equipment having a support structure and a boom structure mounted on the support structure with a workman's platform carried by the boom structure. The boom structure includes means for electrically insulating the workman's platform from the support structure. A source of light is carried by the boom structure. A control mechanism is provided which is accessible from the workmans's platform. The control mechanism has means for receiving light from the light source. At least one light guide means is carried by the boom structure and is coupled to the control mechanism whereby upon operation of the control mechanism a light from said source can be selected and introduced into the one light guide means. Photosensitive means is provided for sensing when light is introduced into the light guide means. Means is provided which is connected to the photosensitive means for operating the lifting equipment whereby the outer end of the boom structure and the workman's platform can be moved with respect to the support structure.

12 Claims, 17 Drawing Figures

LIFTING EQUIPMENT HAVING A BOOM STRUCTURE AND A CONTROL MECHANISM FOR USE THEREWITH USING A FLEXIBLE LIGHT GUIDE

BACKGROUND OF THE INVENTION

In U.S. Letters Pat. No. 3,136,385 there is disclosed control means for use with insulated boom. However, the control means therein disclosed requires the use of a self-contained source power in the workman's basket. This self-contained source of power represents an additional cost to the control mechanism. Such a control mechanism also represents one in which the self-contained source of power must be periodically replaced. In addition, the self-contained power source requires space.

Also, it has been found that lifting equipment utilizing control systems have been difficult to maintain and keep in adjustment. Such lifting equipment has been relatively complex, difficult to assemble, and difficult to service in the field.

There is therefore a need for a new and improved lifting equipment and a control mechanism for use therewith which does not require the use of such a self-contained power supply in the workman's basket and which overcomes the above named disadvantages.

SUMMARY OF THE INVENTION

The lifting equipment consists of a support structure with the boom structure mounted on the support structure. A workmans' platform is carried by the boom structure. The boom structure includes means for electrically insulating the workman's platform from this structure. A source of light is carried by the boom structure. A control mechanism accessible from the workman's platform is provided. The control mechanism has means for receiving light from said source. At least one light guide means is carried by the boom structure and is coupled to the control mechanism. The control mechanism has control means whereby upon operation of the control mechanism the light from said source can be selectively introduced into a set of at least one light guide means. Photosensitive means is provided for sensing when light is introduced into the light guide means. Motive means is connected to the photosensitive means for operating the lifting equipment whereby the outer end of the boom structure of the workman's platform carried thereby can be moved with respect to the support structure.

In general the object of the present invention is to provide a lifting equipment having a workman's basket mounted on the end of an insulated boom which does not require the use of a separate and independent power supply in the workman's basket.

Another object of the invention is to provide lifting equipment of the above character which is relatively simple to assemble and maintain.

Another object of the invention is to provide a lifting equipment of the above character in which there is more space available in the boom structure.

Another object of the invention is to provide lifting equipment of the above character in which the weight of the boom can be reduced.

Another object of the invention is to provide lifting equipment of the above character which has less complexity and requires fewer parts.

Additional objects and features of the invention will appear from the following description in which the preferred embodiments are set forth in detail in conjunction with the accompanying drawings.

DESCRIPTION OF PREFERRED EMBODIMENTS

Figure 1:
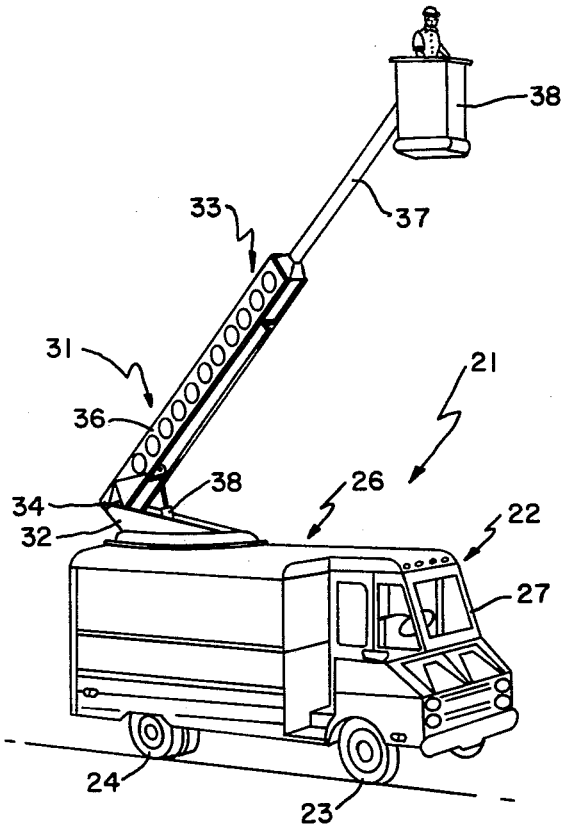
FIG. 1 is a perspective view of a lifting equipment incorporating the present invention.

As shown in the drawings, the lifting equipment 21 consists of a self-propelled vehicle 22 which is provided with front and rear wheels 23 and 24 rotatably mounted upon a chassis or framework (not shown) which serves as a platform. Suitable motive means (not shown) is provided for supplying power to the rear wheels 24 of the vehicle. A van-type body 26 is mounted on the chassis and is of the type described in U.S. Letters Pat. No. 3,437,175. The body 26 includes a cab 27 which encloses a driving station, as shown therein, for driving the self-propelled vehicle. A lifting apparatus 31 is mounted upon the self-propelled vehicle 22 and is of the type described in U.S. Letters Pat. No. 3,437,175. As described in said U.S. Pat. No. 3,437,175, the lifting apparatus includes a support structure 32 and means is provided for mounting the support structure 32 on the chassis of the vehicle 22 to permit rotational movement of the support structure about a substantially vertical axis. Means (not shown) of the type described in said U.S. Pat. No. 3,437,175 is provided for permitting relative rotational movement between the van-type body 26 and the support structure 32. The lifting apparatus includes a boom structure 33 of a telescoping type which is pivotally mounted for movement about a horizontal axis formed by pins 34 carried by the support structure 32. The pivot pins 34 form a pivotal connection between the rear extremity of the outer section 36 and the support structure 32. The boom structure 33 also includes an inner telescoping section 37 formed of a suitable insulating material such as fiberglass. Means is provided for raising and lowering the outer or free end of the boom structure 33 and includes a hydraulic actuator 38 which has one end pivotally connected to the outer boom section 36 as shown in FIG. 1 and has the other end mounted upon the vehicle.

A workman or operator's platform or basket 38 is pivotally secured to the outer end of the telescoping or inner boom section 37 and is also formed of a suitable insulating material such as fiberglass. The basket 38 is pivotally mounted on a pivot pin 39 carried by a bracket 41 mounted on the outer end of the inner boom section 37. A pivotal mounting for the basket 38 permits the basket 38 to continue to assume a level condition as the outer end of the boom structure 32 is raised and lowered about a horizontal axis.

Control means 43 is provided within the bracket 41 and is accessible to the operator in the basket 38 so that the operator in the basket 38 can control the position of the basket from the basket. The control means 43 is in the form of an insulated basket control station. The control means consists of four control arms 46, 47, 48 and 49 which are mounted upon control shafts 51, 52, 53 and 54, respectively. The control arm or lever 46 is provided for controlling in and out motion of the inner telescoping boom section 37 with respect to the outer section 36. The control arm or lever 47 is provided for controlling the clockwise and counter-clockwise rotation of the boom structure. The control arm or lever 48 is provided for up and down movement or, in other words, for raising and lowering the outer end of the boom structure 33. The control arm or lever 49 is provided for starting and stopping the engine-driven generator normally carried by the self-propelled vehicle and for providing an emergency lower for the boom structure. A guard 56 is mounted on the bracket 41 to provide protection to the control arms or levers 46–49.

Figure 3:
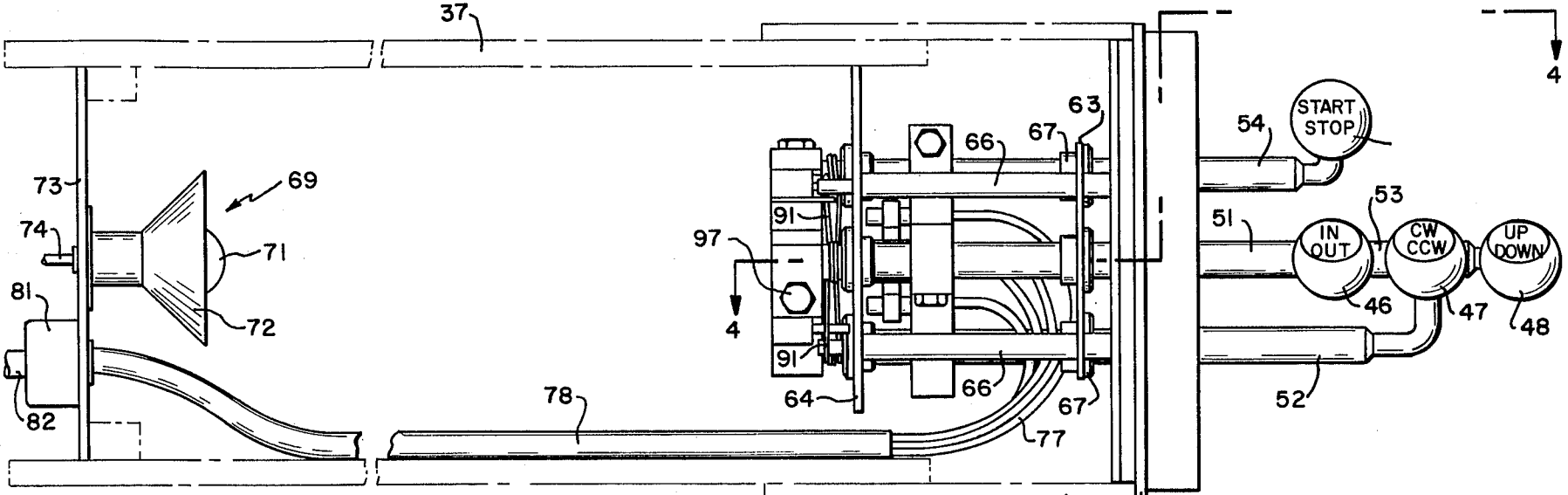
FIG. 3 is an enlarged cross-sectional view showing a portion of the boom structure with the control mechanism carried thereby.
Figure 4:
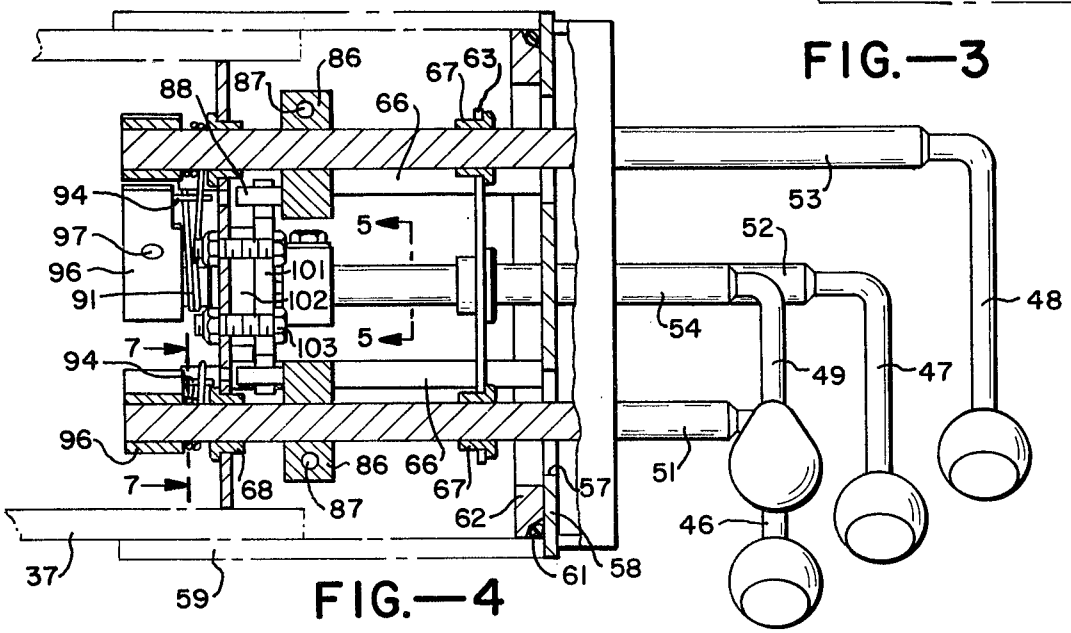
FIG. 4 is a cross-sectional view taken along the line 4—4 of FIG. 3.

A more detailed view of the control means is shown in FIGS. 3 and 4. As shown therein, the shafts 51–54 extend through holes 57 provided in the support plate 58 forming a part of the bracket 41. The bracket 41 includes a cylindrical member 59 which is mounted upon the outer end of the inner insulated boom section 37. An O-ring 61 engages the support plate 58 and is retained in engagement with the support plate and the cylindrical member 59 by a clamping ring 62. Front and rear plates are provided within the bracket 41 and are secured to the support plate 58 by four spaced support rods 66 so that the front and rear plates 63 and 64 are maintained in spaced apart parallel positions. The shafts 51–54 extend through bushings 67 provided in the front plate 63 and bushing 68 provided in the rear plate 64.

In U.S. Letters Pat. No. 3,136,385, there is disclosed a high voltage insulating means in which a control panel is utilized for controlling the operation of the motors which are utilized for operating the lifting equipment. Such a control panel is well known to those skilled in the art and would include a contactor assembly mounted in the panel. An electrical relay is provided for operating the motor contactor. The electrical relay is driven from the output of an electrical amplifier. In the present invention means is provided using light which can be operated by the control means 43 for providing a signal to the electrical amplifier while at the same time providing suitable high voltage insulation for insulating the control means from the outer boom section 36 and the support structure 32. As shown in the drawings, such means consists of a suitable source 69 of light energy such as the lamp 71 mounted in a reflector 72. The reflector 72 is mounted upon a support plate 73 mounted on the rearmost extremity of the inner boom section 37. An electrical cable 74 extends through the plate 73 and is connected to the reflector 72 which carries a socket (not shown) for receiving the lamp 71. As can be seen, the source of light is directed through the length of the inner boom section 37 so that the light rays strike the rear side of the rear plate 65. The rear plate 64 is provided with a plurality of spaced light ports or holes 76 (see FIG. 6) through which the light beams can pass. Four of such holes 76 have been provided, one for each of the control shafts 51, 52, 53 and 54. Means is provided for sensing the light rays passing through the light ports or holes 76 and consists of a plurality of flexible light guides 77. The flexible light guides 77 are bundled together and pass through a large tube 78 mounted in the interior of the inner boom section 37 and extend through the plate 73. For reasons hereinafter explained, at least eight of such light guides 77 have been provided which terminate in a housing 81 mounted on the rear side of the plate 73. The housing 81 includes means for sensing the light passing through each of the light guides of a suitable type such as a photoelectric cell (not shown) mounted within the housing 81. The photoelectric cells are of a conventional type and are positioned in such a manner that one cell is provided for each light guide and is adapted to sense light passing through the light guide. The photocells are connected through a cable 82 to the control panel hereinafter described to provide a signal to the amplifier hereinbefore described which, in turn, control the operation of the motor controllers which operate the motors.

The flexible light guides can be of any suitable type such as Crofon light guides manufactured and sold by DuPont. As is well known to those skilled in the art, Crofon light guides consist of a number of 10 mil diameter plastic fibers which are bundled randomly in a common jacket. Each fiber has a core of polymethyl methacrylate sheathed with a transparent polymer of lower refractive index. The jacket is made of a polyethylene resin. As is well known to those skilled in the art, the basic principle of fiber optics is that light travels in a zigzag path through the transparent core of each fiber by internal reflections for the sheating medium. The amount of light transmitted is a function of the number of fibers in each bundle, the intensity of the light source, the loss characteristics of the sheath/core structure, and the length of the light guide.

Figure 6:
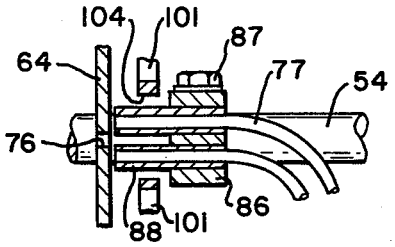
FIG. 6 is a cross-sectional view taken along the line 6—6 of FIG. 5.
Figure 2:
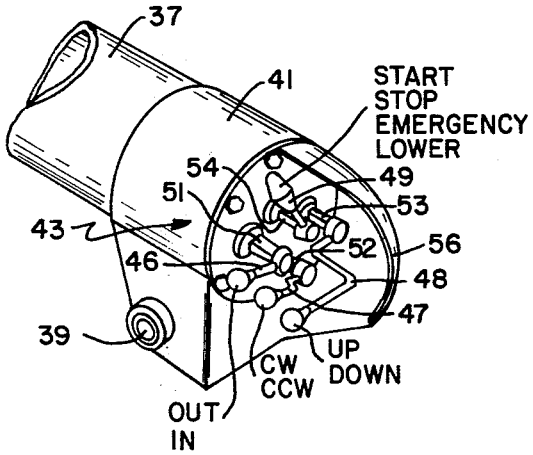
FIG. 2 is an enlarged perspective view of a portion of the telescoping boom structure, and the control mechanism carried thereby utilized in the lifting equipment shown in FIG. 1.
Figure 5:
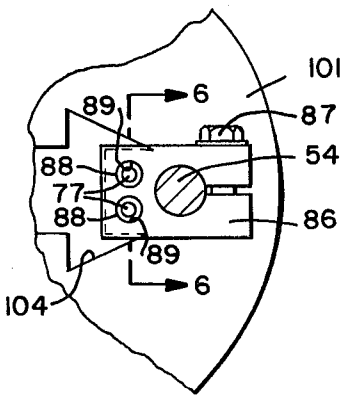
FIG. 5 is a cross-sectional view taken along the line 5—5 of FIG. 4.

Two of the light guides 77 are associated with each of the control shafts 51–54. Such association is accomplished by means of a control element or clamp 86 which is mounted on the shaft. As shown in FIGS. 5 and 6, each of the clamps 86 is split and is clamped to the shaft by a cap screw 87. The ends of each of the light guides 77 are provided with a fitting 88. The two fittings 88 are mounted in two spaced holes 89 provided in the clamp 86 in such a manner so that the light guides 77 carried thereby extend downwardly in directions which are perpendicular to the ports 76 provided in the rear plate 64.

Figure 7:
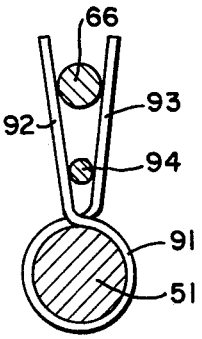
FIG. 7 is cross-sectional view taken along the line 7—7 of FIG. 4.

Means is provided for yieldably retaining the clamps 86 carrying the pair of light guides 77 in such a position so that normally the light guides 77 are disposed on opposite sides of a port 76. Such means is particularly shown in FIGS. 4 and 7 and consists of a torsion spring 91 which is clamped about the associated control shaft such as the control shaft 51 shown in FIGS. 4 and 7. The torsion spring 91 is provided with two legs 92 and 93 which extend outwardly in the form of a V as shown in FIG. 7 and which extend around opposite sides of one of the support rods 66. A centering pin 94 is disposed between the legs 92 and 93 and serves to return the clamp 86 to a centered position with respect to the associated light port 76. The centering pin 94 is carried by a centering block 96. The centering block 96 is also split and is mounted on the associated control shaft and is clamped thereto by a cap screw 97 threaded into the split centering block 96. It can be seen by adjusting the centering block on the shaft, it is possible to position the centering pin 94 so that the torsion spring 91 will bring the associated control shaft to a centered position with respect to the light port or hole 76 so that the light guides 77 carried by the clamp or carrier 86 are disposed on opposite sides of the light port.

Additional means is provided for controlling the movement of the clamp or carrier 86 which carries light guides 77 and consists of a limit plate 101 which is spaced from the rear plate 64 by spacer block 102 and is secured thereto by bolts 103 which extend through the spacer block. The limit plate 101 is provided with a generally triangular slot or opening 104 (see FIG. 5), through which the end fittings 88 of the light guides 77 extend. As can be seen from FIG. 5, the positioning of the end fittings 88 and the hole or slot 104 is such that when the clamping member or carrier 86 is moved in one direction, the one fitting 88 will engage one side of the wall of the limit plate 101 forming the slot 104 and when the shaft is rotated in the opposite direction, the light guide will serve as a limit of travel for the carrier 86 as it strikes the side wall forming the other side of the slot 104 of the limit plate 101.

Operation and use of the lifting equipment may be briefly described as follows. Let it be assumed that it is desired to utilize the lifting equipment in applications in which high voltages may be encountered by the workman in the workman's basket 38 as, for example, when working around elevated high voltage transmission lines. Since the outer boom section 37 is formed of a good insulating material such as fiberglass, the boom itself is capable of withstanding high voltages as, for example, voltages in excess of 60,000 volts. The control means which forms a part of the present invention is constructed in such a manner so that it also can readily withstand such high voltages and still protect the operator in the same way as described in U.S. Letters Pat. No. 3,136,385. The control means of the present invention, however, has the distinct advantage in that it does not require a separate source of power in the workman's basket. In the embodiment of the present invention, one of the power supplies carried by the vehicle for the motors can be utilized for energizing the lamp 71 by control of a switch (not shown) in the control panel. Light emitted from the light source 71 will pass through the light ports 76, however, nothing will occur with respect to the operation of the lifting equipment when the operating arms or handles 46, 47, 48 and 49 are in their neutral or centered positions as shown in the drawings because none of the light guides 77 are in a position to receive a significant amount of energy from the light passing through the light ports 76. This is because the light guides are disposed on opposite sides of the light ports 76 as hereinbefore described.

Now let it be assumed that it is desired to perform a certain operation with the lifting equipment. One or a number of the control handles 46, 47, 48 and 49 can be operated individually or simultaneously to obtain the desired movement of the workman's basket 38. Thus, for example, let it be assumed that it is desired to raise the outer end of the boom structure and to raise the workman's basket. The control handle 48 is raised which causes counter-clockwise movement of the shaft 53 which, in turn, causes one of the light guides 77 to be moved into registration with the associated light port so that light being transmitted from the light source 71 through the light port passes through the light guide and to the associated photocell provided in the housing 81 to the amplifier, control relay and the motor contactor to cause energization of the electric motor to cause raising of the boom in the manner described in U.S. Letters Pat. No. 3,136,385. As soon as the control level 48 is released, the control lever will be returned to the neutral position which will cause deenergization of the motor and stop further upward movement of the workman's basket. Conversely, when it is desired to lower the workman's basket, the control arm or lever 48 is moved downwardly to rotate the shaft 53 in a counter-clockwise direction to cause another light to be brought into registration with the light port to cause energization of the relay and the motor controller to cause the motor to operate in the opposite direction to lower the boom structure. Telescoping movement or in and out movement of the inner boom section 37 with respect to the outer boom section 36 can be accomplished by operation of the control lever 46 in either of two directions. Similar clockwise or counter-clockwise rotation of the boom structure 33 can be accomplished by operation of the control lever or arm 47 to cause operation of the motors in the manner described in U.S. Letters Pat. No. 3,136,385. Starting and stopping of the electrical generator carried on the lifting equipment as described in U.S. Letters Pat. No. 3,136,385 can be controlled by the control arm or lever 49.

Figure 8:
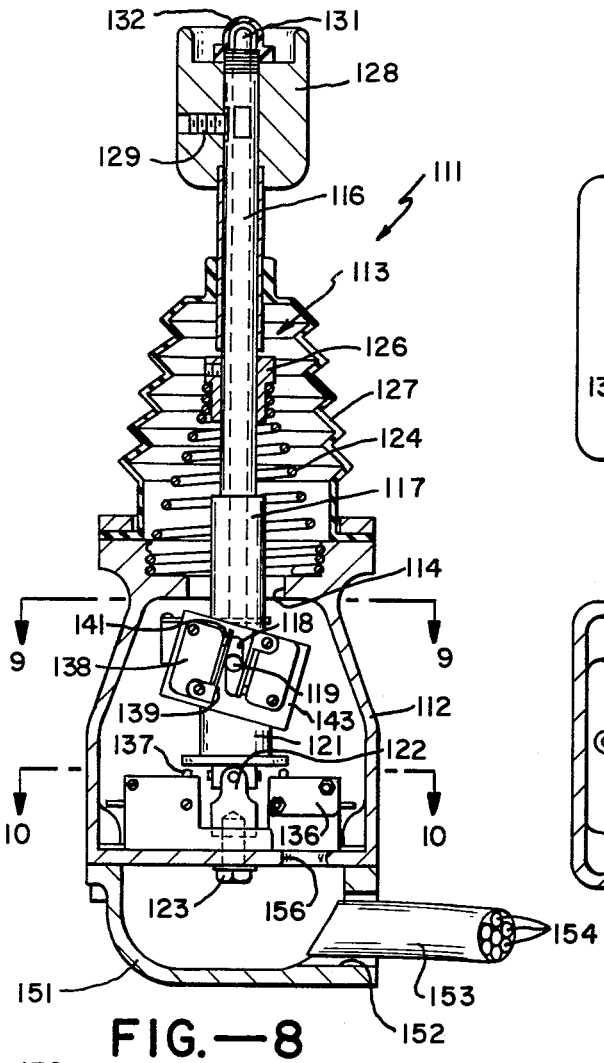
FIG. 8 is a cross-sectional view of an alternative embodiment of a control mechanism for use with the lifting equipment which is shown in FIG. 1.

Another embodiment of the control means which can be utilized in conjunction with the present invention is shown in FIGS. 8–15 and utilizes a control mechanism of the type described in U.S. Letters Pat. Nos. 2,841,659 and 2,627,560. The control mechanism 111 shown in FIG. 8 is of a type which is adapted to be mounted in the workman's basket 38 or to be carried by a workman's platform and consists of an aluminum casting 112. As disclosed in U.S. Letters Pat. No. 2,841,659, a control lever 113 extends upwardly through a hole 114 provided in the casting. The control lever 113 comprises an upper tubular member 116 which is slidably mounted in a lower tubular member 117. The lower tubular member 117 is provided with a slot 118 which cooperates with a pin 119 carried on the lower end of the upper tubular member to limit the relative movement between the members 116 and 117. The lower tubular member 117 is provided with a flanged member 121 which is fastened to the upper portion of a universal joint 122 that is secured to the casting 111 by cap screw 123. The control lever 113 is yieldably retained at rest or a centered position by a conical shaped spiral spring 124 which has its lower end seated in the upper extremity of the casting 111 and which has its upper extremity fitted on a collar 126 which is secured to the tubular member 116. An accordion type sleeve 127 is mounted on the upper extremity of the casting 111 and encloses the spring 124 and is secured to the upper tubular member 116. A control knob 128 is secured to the upper end of the tubular member 116 by a set screw 129. An operating rod 131 is slidably mounted within the tubular member 116 and is covered by a small resilient cap 132 provided in the control knob 18. Four switches or control assemblies 136 are disposed within a horizontal plane within the housing or casting 112 and each is provided with an operating member 137 which is adapted to be engaged by the flanged member 121. The control assemblies or switches 136 are arranged in pairs with the control assemblies or switches in each pair being opposite each other by 180° so that they are operated by movement of the control lever in directly opposite tilting directions.

Another pair of control assemblies or switches 138 are provided which are identical to the control assembly switches 136 with the exception that they are provided with pivoted operating levers 139 that are adapted to engage control members 141 which are similar to the control members 137. The control levers 139 are adapted to be engaged by the pin 119 carried by the upper tubular member 116. The control assemblies 138 are mounted upon the plate 142 which is secured to the flanged member 121.

Another control assembly 143 is secured to a plate 144 also secured to the flanged member 121. The control assembly 143 is provided with a control member 146 which is adapted to be engaged by a leaf spring member 147. As described in U.S. Letters Pat. No. 2,841,659, the leaf spring 147 is provided with a portion 147a which extends through slots 148 (not shown) provided in the members 116 and 117 and provides a support for the control rod 131.

A conduit box 151 is secured to the lower portion of the casting 112. The conduit box 151 is provided with an opening 152 which is adapted to receive a tube 153 that carries a plurality of light guides 154 identical to the light guides 77 hereinbefore described. The light guides 154 extend upwardly through holes 156 provided in the casting 112 and extend into the control assemblies 136, 138 and the control assembly 143.

A number of different embodiments of such control assemblies are shown in FIGS. 11–15. However, in all of the embodiments, it is necessary that light from the light source be supplied through at least one light guide to each of the control assemblies. Thus, to accomplish this, the large tube 153 carrying the light guides would have to be separated at the lower extremity of the inner telescoping boom 37 so that certain of the light guides would be mounted over the source of light 71, whereas other of the light guides would enter the housing 81 so that their outputs could be sensed by the photoelectric cells contained therein.

Figure 11:
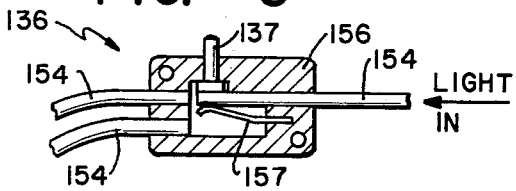
FIGS. 11, 12, 13, 14 and 15 are cross-sectional views showing alternative embodiments of the control means or switching elements which can be utilized in the control mechanism shown in FIGS. 8, 9 and 10.

Thus, as shown in the embodiment of the control assembly as shown in FIG. 11, each of the control assemblies includes a housing 156. A light guide 154 which is in communication with the light source is introduced into one end of the housing and has its inner end engagable by the member 137 as shown in FIG. 11. A yieldable spring member 157 is provided within the housing and yieldably urges the extremity of the light guide 154 into engagement with the member 137. Two separate light guides 154 are provided on the opposite sides of the housing 156 and are positioned in such a manner so that the first light guide which is in contact with the source of light can be moved into registration with either of the two light guides by operation of the member 137. As can be seen from FIG. 11, the light guide 154 which is in communication with the source of light is in registration with the upper light guide on the other end. When the member 137 is depressed against the force spring 157, it can be moved into registration with the lower light guide 154 as shown in FIG. 11 to supply a light signal to that light guide. Thus, it can be seen by the two positions of the inner flexible end of the light guide 154 in communication with the source of light, light can be introduced into either of the two light guides 154 to control relays, motor contactors and the like in the manner hereinbefore described to control the operation of the lifting equipment.

Figure 12:
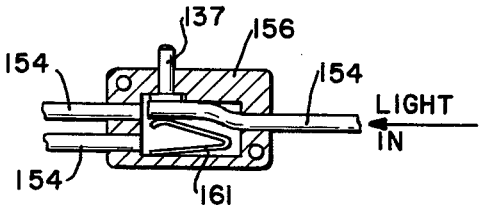

Another embodiment of the control mechanism is shown in FIG. 12 which is very similar to that shown in FIG. 11 except that a V-shaped spring 161 is utilized in place of the spring 157. The principles of operation are basically the same as in FIG. 11.

Figure 13:
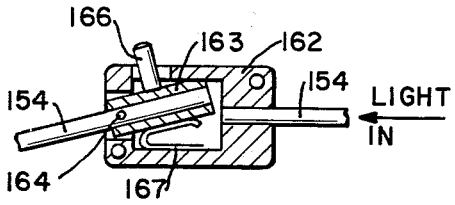

In FIG. 13 there is shown another embodiment of the control mechanism in which the control mechanism consists of a housing 162 which has one of the light guides 154 in communication with the source of light mounted on one end thereof. Another light guide is provided in the other end of the housing 162 and is provided with a fitting 163 which can be rigid and which is pivotally mounted within the housing upon a pin 164. The fitting 163 carries an operating member 166. A generally vee-shaped spring 167 is provided within the housing 162 and is adapted to engage the end fitting 163 and yieldably urges the fitting 163 upwardly on the pivot pin 64 so that the light guide 154 carried thereby is out of registration with the end of the light guide 154 in communication with the light source. When it is desired to accomplish a control or switching operation it can be seen that it is then necessary to move the operating member 166 to compress the spring 167 to move the end of the light guide carried by the fitting 163 into registration with the light guide 154 in communication with the source of light so that it will transmit light to the photoelectric cell carried within the housing 81. This signal can be utilized to accomplish switching or control operations of the type hereinbefore described.

Figure 14:
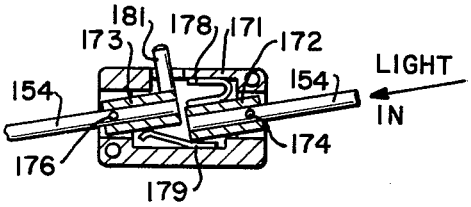

Another embodiment of the control mechanism is shown in FIG. 14 which is the same as that shown in FIG. 13 with the exception that the rocking motion is accomplished by the movement of both of the light guides in the housing rather than just one of the light guides in the housing. Thus, in FIG. 14 there has been provided a control mechanism having a housing 171 carrying both the light guides 154 provided in the fitting 172 and 173 mounted thereon respectively. The fittings 172 and 173 are carried by pivot pins 174 and 176 respectively and mounted in the housing. A U-shaped spring 178 is mounted in the housing 171 above the fitting 172. A rigid pivot member 179 is mounted in the lower portion of the housing and has one end engaging the fitting 173 and has the other end engaging the fitting 172. The fitting 173 is provided with an operating member 181. It can be seen by viewing FIG. 14 that a teeter-totter arrangement is provided whereby when the member 181 is depressed the fitting will engage the member 179 to move the fitting 172 upwardly against the force of the spring 178 so that the two light guides 154 can be brought into alignment with each other so that light being carried by one of the light guides can be transmitted to the other light guide. As soon as the member 181 is released, the spring 178 will cause a reverse rocking operation to occur to move the two light guides out of registration with each other. Thus it can be seen that there has been provided a control mechanism in which switching and control operations can be readily accomplished.

Figure 15:
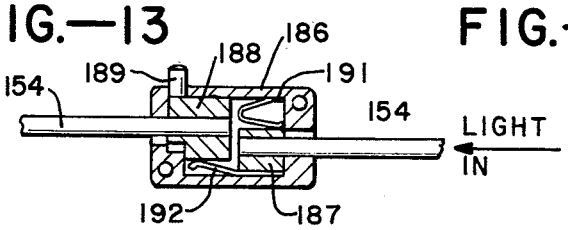

Another embodiment of the control mechanism is shown in FIG. 15 which utilizes the teeter totter principle as shown in FIG. 14 but which also utilizes a generally rectilinear movement rather than the rocking movement provided in FIG. 14. Thus there has been provided a housing 186 in which two of the light guides 154 have been provided and have fittings 187 and 188 mounted thereon. The fitting 188 carries an operating member 189. A U-shaped spring member 191 is mounted over the fitting 187. A rigid pivot member 192 is provided in the bottom of the housing 186 and engages both of the fittings 187 and 188. As soon as the operating member 189 is depressed downwardly, it will cause rocking motion of the pivot member 192 to move the fitting 187 and the light guide carried thereby upwardly against the force of the spring 191 to bring the two light guides 154 into engagement with each other so that the light carried by one of the light guides can be transmitted to the other light guides. Thus again it can be seen that the control mechanism shown in FIG. 15 can be utilized for control and switching operations of the type hereinbefore described. As soon as the member 189 is released, the force of the spring 191 will move the two light guides 154 out of registration with each other to the position shown in FIG. 15.

Figure 9:
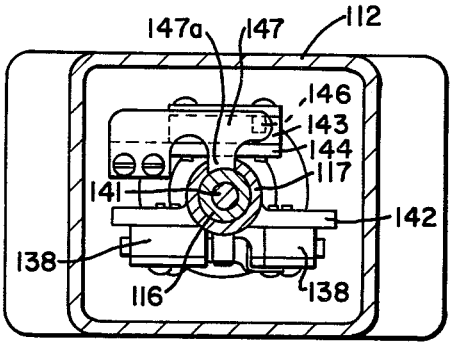
FIG. 9 is a cross-sectional view taken along the line 9—9 of FIG. 8.
Figure 10:
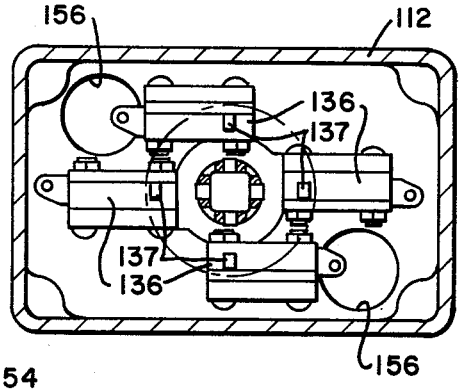
FIG. 10 is a cross-sectional view taken along the line section 10—10 of FIG. 8.

From the foregoing it can be seen that any one of the control mechanisms shown in FIGS. 11 through 15 can be utilized in the control assembly 111 shown in FIGS. 8, 9 and 10. The control mechanism 111 has the advantage in that the control operations which are to be performed have a direct correspondence to the direction of movement of the control knob 128. Thus, when the control knob 128 is raised upwardly, the outer end of the boom structure will be raised. Conversely, when it is moved downwardly, the outer end of the boom structure will be moved downwardly. When it is rocked in a forward direction, the boom structure will be extended. When it is rocked rearwardly, it will be retracted. Also, when it is rocked sideways in one direction, it will be rotated about a vertical axis and conversely, when it is rocked sideways in the opposite direction, it will be rotated in the opposite direction.

Figure 16:
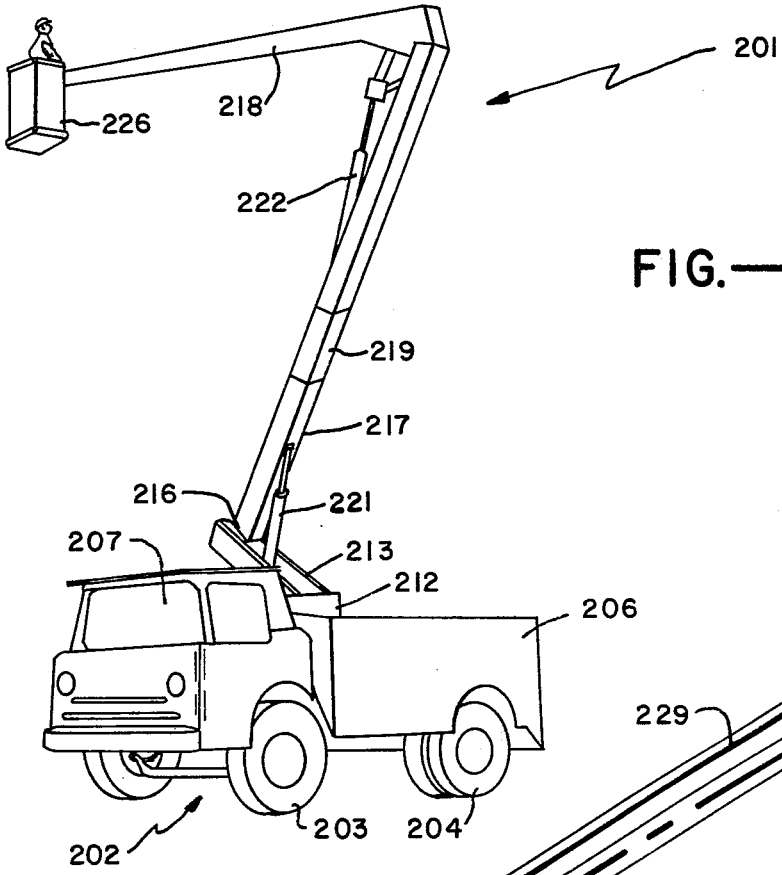
FIG. 16 is a perspective view of another embodiment of lifting equipment incorporating the present invention.
Figure 17:
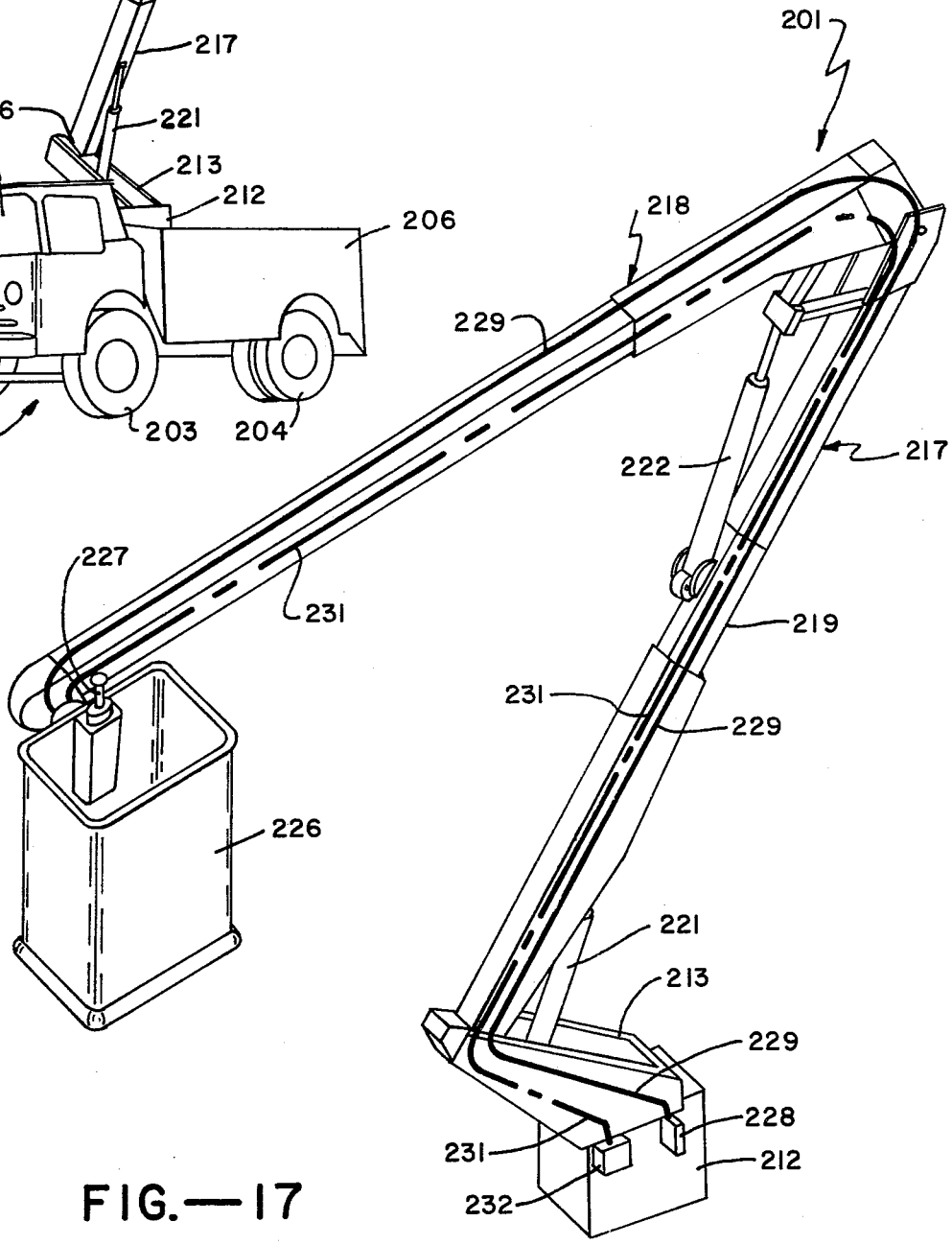
FIG. 17 is an enlarged perspective view of a portion of the elbow type boom structure and the control mechanism carried thereby utilized in the lifting equipment shown in FIG. 16.

Another embodiment of the lifting equipment is shown in FIGS. 16 and 17. As shown therein, the lifting equipment 201, which also can be termed an aerial lift, consists of a self-propelled vehicle 202 of the type hereinbefore described which is provided with front and rear wheels 203 and 204 which are carried by a chassis or framework (not shown) which serves as a platform. Suitable motive means (not shown) is provided for supplying power to the rear wheels 204 of the vehicle. A cabinet type body 206 is mounted on the chassis and overlies the rear wheels 204. A cab 207 is also mounted on the chassis and overlies the front wheels 203. The cab includes a driving station as shown on the drawing to permit driving of the self-propelled vehicle. The lifting apparatus 211 is mounted upon the platform on the self-propelled vehicle. The lifting apparatus includes a base 212 which is mounted upon the platform of the vehicle. A support structure 213 is mounted upon the base 212. The support structure and the base is provided with means of a conventional type which is provided for permitting rotational movement of the support structure about a vertical axis with respect to the base 212. An articulated or elbow-type boom structure 216 is carried by the support structure 213. The boom structure 216 includes a lower boom section 217 which has its lower extremity pivotally connected to the upper end of the support structure 213. An upper boom section 218 has its lower end pivotally connected to the upper end of the boom section 217. The lower boom section 217 includes a section 219 formed of insulating material which is disposed between the ends of the lower boom section 217 as shown in FIG. 17. Means is provided of a conventional type for causing pivotal movement of the lower boom section 217 with respect to the support structure 213 and includes a hydraulic actuator 221. Similarly, means is provided for causing pivotal movement of the upper boom section 218 with respect to the lower boom section 217 and includes a hydraulic actuator 222.

A workman's platform or basket 226 is carried by the outer end of the upper boom section 218. A joy stick control 227 of the type shown in FIGS. 8, 9 and 10 is carried by the outer end of the upper boom section 218 and is accessible to the workman in the basket 226.

In accordance with the present invention, it is desirable that the basket 226 in conjunction with the control means 227 provide an insulated control station in accordance with the teaching of the previous embodiments of this invention. Thus, there is provided a source of light 228 which is mounted in the base 212. However, in connection with the present invention, it should be appreciated that this source of light can be mounted in any suitable location as long as it is below the insulated boom section 219. Thus, for example, it could be provided in the lower extremity of the lower boom section 217 if desired. A plurality of light guides 229 of the type hereinbefore described have their ends in communication with the source of light and extend upwardly through the lower boom section 217 and then extend past the articulated connection between the upper and lower boom sections 217 and 218 and are connected into the control mechanism 227 in the manner disclosed in FIG. 8. A plurality of return light guides 231 of the type hereinbefore described are also connected to the control mechanism 227 and extend downwardly through the upper and lower boom sections in the same manner as the light guides 229. The light guides 231 extend into a control box 232 provided in the base 212. Photosensitive means of the type hereinbefore described are provided for sensing whether or not the light is present on each of the light guides and this information is utilized to supply an electrical signal through amplifier means if required and then to solenoid operated hydraulic control valves which are utilized for controlling the supply of fluid to the actuators 221 and 222 for controlling the movement of the upper and lower boom sections 217 and 218 of the boom structure 216.

In operation of the lifting equipment 201, it can be seen that the movement of the boom structure can be controlled by the operation of the control mechanism 227 to move the outer end of the boom structure so it can be rotated about a vertical axis, and moved toward and away from the vehicle. The control mechanism makes it possible to control these movements and at the same time providing adequate insulation for the operator in the workman's basket 226. By utilizing flexible light guides of the type hereinbefore described, it is possible to utilize the light guides in connection with an articulated boom structure such as shown in FIGS. 16 and 17 because the light guides can readily follow the articulated movement of the boom structure without adversely affecting the light guides. Thus, it can be seen that the present invention is equally applicable to articulated boom structures as well as telescoping boom structures.

It is apparent from the foregoing that there has been provided a lifting equipment which has many advantages particularly in high voltage applications. As pointed out previously, one of the principal advantages is that the source of power is not required in the workman's basket but the source of power, i.e., the source of light, can be provided at the lower extremity of the boom structure while still retaining the desired insulating properties for the control mechanism. In general, the control mechanism utilized in connection with the lifting equipment is relatively simple to maintain. In addition, it is relatively simple to assemble particularly in view of the fact that it requires less space within the boom structure.

What is claimed is:

1. In a lifting equipment, a support structure, a boom structure movably mounted on said support structure, a workman's platform carried by the boom structure, the boom structure including means for electrically insulating the workman's platform from the support structure, a source of light electrically insulated from said workman's platform, a control mechanism accessible from the workman's platform, means for supplying light from said source to said control mechanism, at least one flexible light guide means carried by the boom structure and coupled to the control mechanism, said control mechanism having control means whereby upon operation of said control means light from the source can be selectively introduced into said flexible light guide means, photosensitive means for sensing when light is introduced into said light guide means and motive means connected to said photosensitive means for operating the lifting equipment whereby the outer end of the boom structure and the workman's platform can be moved relative to the support structure.

2. A lifting equipment as in claim 1 wherein two of said flexible light guide means are provided together with means for causing relative movement between two of said light guide means and said means for receiving light from said source.

3. Lifting equipment as in claim 2 wherein said source of light is a single source of light.

4. Lifting equipment as in claim 3 wherein said means for receiving light from said source includes a member having at least one aperture therein through which light is adapted to pass.

5. Lifting equipment as in claim 1 wherein said boom structure is of the telescoping type.

6. Lifting equipment as in claim 1 wherein said boom structure is of the articulated type.

7. Lifting equipment as in claim 1 wherein said means for supplying light to said control mechanism includes a space provided within the boom structure extending from said source of light electrically insulated from said workman's platform to the control mechanism.

8. Lifting equipment as in claim 1 wherein said source of light electrically insulated from said workman's platform includes at least one light guide means.

9. Lifting equipment as in claim 8 wherein said boom structure has upper and lower boom sections and means for forming an articulated connection between the upper and lower boom sections and wherein said at least one light guide means extending from said source of light to the control mechanism extends over the articulated connection.

10. In a lifting equipment, a support structure, a boom structure movably mounted on said support structure, a workman's platform carried by the boom structure, the boom structure including means for electrically insulating the workman's platform from the support structure, a source of light, a control mechanism accessible from the workman's platform, means for supplying light from said source to said control mechanism having a plurality of apertures therein and wherein said source of light is positioned so that light from said source passes through said apertures, at least one light guide means carried by the boom structure and coupled to the control mechanism for each of said apertures, said control mechanism having control means for moving said light guide means into and out of registration with the associated aperture, photosensitive means for sensing when light is introduced into said light guide means and motive means connected to said photosensitive means for operating the lifting equipment whereby the outer end of the boom structure and the workman's platform can be moved relative to the support structure.

11. Lifting equipment as in claim 10 wherein at least two of said light guide means are provided for each of said apertures and wherein said control mechanism includes means for moving either of said two light guide means associated with each of said apertures into and out of registration with said aperture.

12. Lifting equipment as in claim 11 wherein said control mechanism includes means for yieldably retaining both of said light guide means associated with each aperture out of registration with the aperture.

* * * * *